US006608272B2

(12) United States Patent
Garcia

(10) Patent No.: US 6,608,272 B2
(45) Date of Patent: Aug. 19, 2003

(54) ILLUMINATING ROTARY SWITCH

(75) Inventor: Ricardo L. Garcia, Fountain Valley, CA (US)

(73) Assignee: Cole Instrument Corporation, Santa Ana, CA (US)

( * ) Notice: Subject to any disclaimer, the term of this patent is extended or adjusted under 35 U.S.C. 154(b) by 0 days.

(21) Appl. No.: 09/772,703

(22) Filed: Jan. 30, 2001

(65) Prior Publication Data

US 2002/0100672 A1 Aug. 1, 2002

(51) Int. Cl.[7] ..... H01H 9/00
(52) U.S. Cl. ..... 200/316; 200/11 R
(58) Field of Search ..... 200/316, 11 R, 200/17 R; 362/555

(56) References Cited

U.S. PATENT DOCUMENTS 2,087,935 A * 7/1937 Batcheller ..... 177/311
2,091,155 A * 8/1937 Merkel ..... 177/311
2,165,199 A * 8/1939 Batcheller ..... 201/53
2,449,213 A 9/1948 Fredrick
2,710,954 A * 6/1955 Hallerberg et al. ..... 340/252
2,786,904 A 3/1957 Hewes et al.
3,721,789 A * 3/1973 Black ..... 200/167 R
3,725,724 A 4/1973 Vollum
4,044,214 A 8/1977 Rayburn et al.
4,104,981 A * 8/1978 Ono et al. ..... 116/124
4,176,265 A 11/1979 Mobus et al.
4,910,364 A 3/1990 Garcia
5,204,502 A * 4/1993 Ferris et al. ..... 200/4
5,326,944 A 7/1994 Garcia
5,606,155 A 2/1997 Garcia
5,641,952 A 6/1997 Collings
5,817,996 A * 10/1998 Ulrich et al. ..... 200/4
5,901,835 A 5/1999 Hung
5,901,836 A 5/1999 Taniuchi
5,913,414 A 6/1999 Pollock et al.
6,130,386 A * 10/2000 Jorczak ..... 200/17 R

* cited by examiner

*Primary Examiner*—Elvin Enad
*Assistant Examiner*—Lisa N Klaus

(57) ABSTRACT

The present invention is a rotary switch with illumination capabilities utilizing a light pipe within the rotary switch to carry light from a light source to the outside of the rotary switch. The light source is preferably an LED or incandescent bulb, and the light pipe may be a fiber optic material or a glass tube. In conjunction with the rotary switch is a corresponding knob that includes a lens disposed adjacent the end of the light pipe for dispersing light communicated through the light pipe to a face on the knob. The rotary switch may include multiple lights corresponding to operating conditions of the rotary switch such as nominal and fail, where the operator can determine the condition by the color of light passing through the lens on the knob.

15 Claims, 1 Drawing Sheet

ILLUMINATING ROTARY SWITCH

BACKGROUND OF THE INVENTION

1. Field of the Invention

The invention relates generally to rotary switches and more particularly to a rotary switch with illumination capabilities.

2. Description of Related Art

Electro-mechanical rotary switches are used in various fields to provide multi-circuit control capability. The rotary switch is commonly found in such applications as aircraft, medical equipment, computers, industrial controls, communication, ordnance, and ground support equipment. Rotary switches may be comprised of a cylindrical body housing metal contact segments which can be manipulated to open and close circuits connected to the rotary switch. An example of the workings of a rotary switch is provide in U.S. Pat. No. 4,910,364 to Garcia (the present inventor), and is incorporated herein by reference.

Many rotary switches are employed in locations and environments that may lack sufficient lighting, such as aircraft, computers, machinery, and so forth. The lack of sufficient light may make operating or repairing the switch difficult. However, the need to maintain a compact housing for many applications makes the inclusion of lighting impractical in many cases. There is a need for incorporating an illuminating function into the housing of a rotary switch without altering the compact housing of the rotary switch.

SUMMARY OF THE INVENTION

The present invention adds an illuminating feature to the rotary switch by replacing a main shaft traversing the longitudinal axis of the rotary switch with a light pipe terminating at the switch control (or knob) end. With an illumination source such as an LED or incandescent lamp within the switch housing at a first end of the light pipe transmitting light to the switch knob at the other end of the light pipe, the present invention can illuminate a rotary switch knob thereby reducing operating mistakes.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a rotary switch with an illuminated knob.

Figure 1:
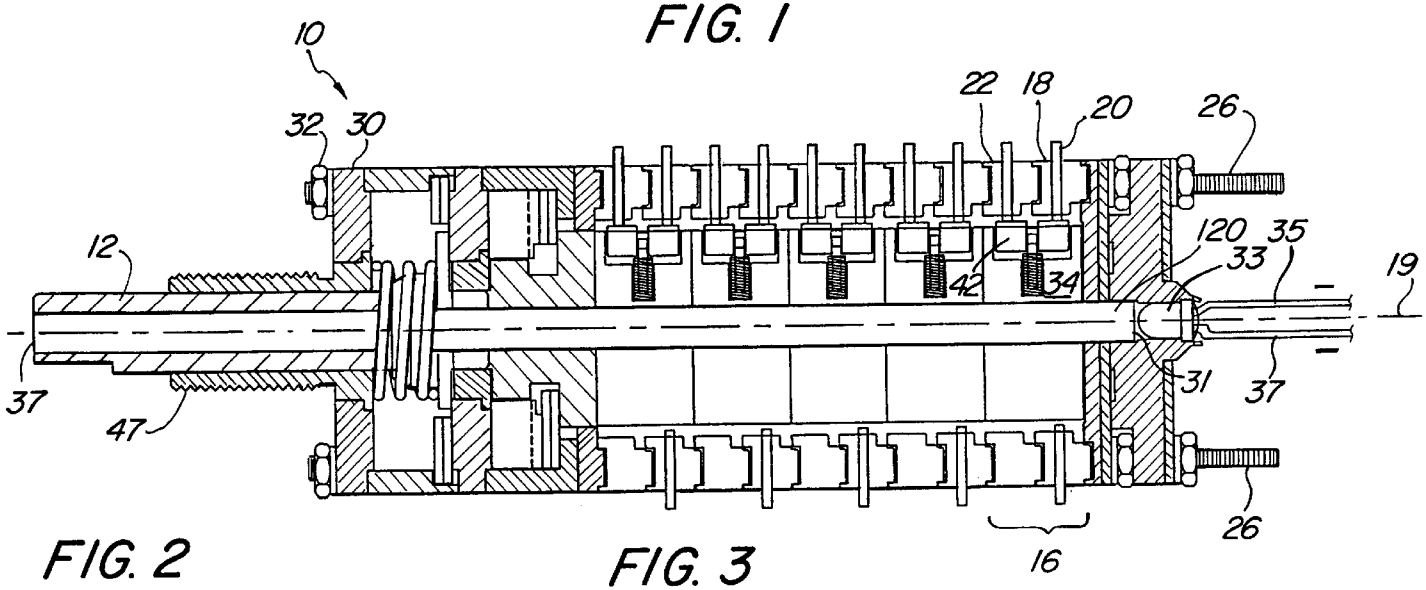
FIG. 1 is a side view of the rotary switch in cross-section.

FIG. 1 is a cross sectional view of a rotary switch of the present invention showing the various connectors for a plurality of terminals as described more fully in the incorporated reference. The switch 10 comprises a body comprising one or more decks 16 each of which includes a frame member 18 having a common terminal 20 and a second frame member 22 with a set of individual contacts which are sequentially connected to the common terminal. FIG. 1 shows five decks, although more or fewer decks are possible without deviating from the scope of the invention. The switch is held together by a pair of long struts 26 which are carried by the switch housing. The opposite end of the strut is anchored in an end plate 30, and a nut 32 on the end of the threaded strut cooperate to hold the assembly together.

Each deck provides multiple contacts through rotation of the switch, thereby allowing a plurality of circuit paths via the switch. Each deck includes a contact drum 34 that houses a barbell shaped contact 42 used to provide electrical contact between a universal contact and a selected individual contact on the deck. The contact drums are centered within the switch 10 by a tube 12 substantially traversing the switch along the longitudinal axis 19. The tube 120, which also functions as a light pipe, extends from the base of the switch and passes through each deck to the main shaft. The light pipe 120 can be an optical fiber, plastic or glass rod, or other well known device for communicating light with a minimal loss along the transmission. The light pipe 120 is preferably mounted within the main shaft 12 of the switch using a suitable adhesive, and replaces a length of the main shaft that previously passed through the contact drums. The light pipe passes through the contact drums at an aperture sized to receive the light pipe, and the light pipe can be used to align the contact drums.

When the power supply is acivated, light is communicated through the light pipe 120 to the end of the switch shaft with preferably a minimal loss of light through the length of the light pipe. At the light transmitting end 137 of the light pipe 120, light leaving the end of the light pipe is preferably collected by a lens on a cooperating knob member which disperses the light onto the knob face. In one alternative preferred embodiment, two light sources are laced at the light receiving end of the light pipe 120 representing two conditions for the switch 10. A light of one color could represent a nominal condition, and a second light of a different color could represent a failure condition. An operator could then be informed of a switch failure and arrange its repair or replacement before the damaged switch can lead to other problems.

When the power supply is activated, light is communicated through the light pipe 120 to the end of the switch shaft with preferably a minimal loss of light through the length of the light pipe. At the light transmitting end 37 of the light pipe 120, light leaving the end of the light pipe is preferably collected by a lens on a cooperating knob member which disperses the light onto the knob face. In one alternative preferred embodiment, two light sources are placed at the light receiving end of the light pipe 120 representing two conditions for the switch 10. A light of one color could represent a nominal condition, and a second light of a different color could represent a failure condition. An operator could then be informed of a switch failure and arrange for its repair or replacement before the damaged switch can lead to other problems.

Figure 3:
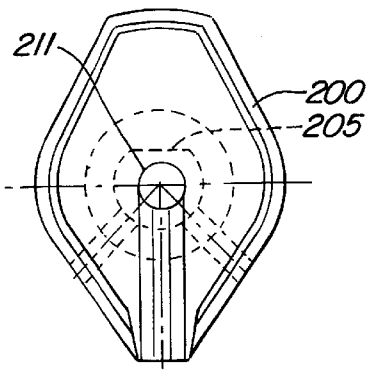
FIG. 3 is a front view partially in phantom of the knob of FIG. 2.
Figure 2:
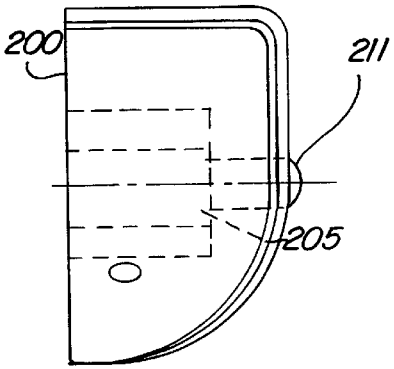
FIG. 2 is a side view partially in phantom of a knob with a lens for use with the present invention.

FIGS. 2 and 3 illustrate a lens and knob combination suitable for the present invention. The knob 200 is placed over the end of the main shaft 12 of the switch 10 and a bore 205 in the knob 200 accommodates the light pipe 120 and main shaft 12. Outer threads 47 on the main shaft 12 of the rotary switch 10 engage inner threads in the bore of the knob 200 to secure the knob to the rotary switch. Adjacent the bore of the knob and the end of the light pipe is a generally hemispherical lens 211 that disperses light emanating from the light pipe in a radial direction on the knob face. In this manner the illuminating rotary switch provides light to a dial or knob secured on the rotary switch. The choice of light color can be selected based on visibility criteria, where a white light may be appropriate in some environments but a colored light such as yellow or red may be more appropriate in another environment. Alternatively, different light sources may reflect a safety condition or a warning condition. For example, a red light may indicate a failure condition, whereas a yellow light may indicate a warning and a green light indicates a nominal condition.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What I claim is:

1. An improved rotary switch having a rotating contact member for determining a circuit path from among several possible circuit paths, the improvement comprising:

a light pipe dispose within the rotary switch along a longitudinal axis, the light pipe having first and second ends and where a first end lies in a shaft that protrudes through an end of the rotary switch and a second end located within the rotary switch;

a plurality of contact decks arranged longitudinally along the rotary switch, a contact drum associated with each contact deck, the contact drum including a contact to provide electrical contact between a universal contact and a selected individual contact on the deck; and, a light source disposed within the rotary switch and adjacent the second end of the light pipe, whereby illumination from the light source is carried through the light pipe and transmitted at the first end of the light pipe to illuminate the shaft.

2. The improved rotary switch of claim 1 wherein the light source is a light emitting diode (LED).

3. The improved rotary switch of claim 1 wherein the light source is an incandescent light bulb.

4. The improved rotary switch of claim 1 wherein the light pipe is a glass tube.

5. The improved rotary switch of claim 1 wherein the light pipe is an optical fiber.

6. The improved rotary switch of claim 1 further including a removable knob adapted to be secured on the rotary switch generally at the first end of the light pipe, the knob including a lens disposed adjacent the first end of the light pipe for dispersing light emitting from the light pipe on a face of said knob.

7. The improved rotary switch of claim 1 further comprising a second light source disposed adjacent the light pipe, wherein the first and second light sources correspond to first and second conditions relating to the rotary switch, the first light source illuminating upon the event of a first condition and the second light source illuminating upon the event of a second condition.

8. A rotary switch with illuminating knob face comprising:

a plurality of contact decks arranged longitudinally along the rotary switch, each deck including a contact drum with a universal contact in rotatable contact with an individual contact member corresponding to individual circuit paths;

a light pipe passing through a center of one or more contact drums and extending outside a body of the rotary switch within a shaft also protruding outside the body of the rotary switch;

a light source disposed within the body of the rotary switch adjacent a light receiving end of the light pipe, said light source including terminals connectable to a power source outside the rotary switch; and a knob adapted to be secured to the body of the rotary switch at the shaft protruding outside the body of the rotary switch, the knob including a lens disposed on the knob such that the lens is adjacent a light transmitting end of the light pipe within the shaft when the knob is secured to the rotary switch, whereby light from the light source is communicated through the rotary switch in the light pipe and received by the lens on the knob secured to the rotary switch, and where the lens dsperses the light on the face of the knob.

9. The rotary switch of claim 8 wherein the light source is a light emitting diode (LED).

10. The rotary switch of claim 8 wherein the light source is an incandescent light bulb.

11. The rotary switch of claim 8 wherein the light pipe is a glass tube.

12. The rotary switch of claim 8 wherein the light pipe is an optical fiber.

13. The rotary switch of claim 8 further comprising a second light source disposed adjacent the light pipe, wherein the first and second light sources correspond to first and second conditions relating to the rotary switch, the first light source illuminating upon the event of a first condition and the second light source illuminating upon the event of a second condition.

14. The rotary switch of claim 8 wherein the light source is selected from different colors based on a visibility criteria.

15. An improved rotary switch having a longitudinal axis and a rotating contact member for determining a circuit path from among several possible circuit paths, the improvement comprising:

a light pipe disposed within a shaft along the longitudinal axis, the light pipe having a first and second end where the shaft and the first end of the light pipe extend from the rotary switch and the second end of the light pipe is located within the rotary switch;

a light source disposed exterior to the light pipe and adjacent the second end of the light pipe, whereby illuminati n from the light source is transmitted at the first end of the light pipe; and a plurality of contact decks arranged longitudinally along the rotary switch, a contact drum associated with each contact deck, the contact drum including a contact to provide electrical contact between a universal contact and a selected individual contact on the deck.

* * * * *